US008583021B2

(12) United States Patent
Kadis et al.

(10) Patent No.: US 8,583,021 B2
(45) Date of Patent: Nov. 12, 2013

(54) IMAGE FORMING APPARATUS INCLUDING SPONGE APPLICATOR UNITS TO SEQUENTIALLY CONTACT A PHOTOCONDUCTIVE MEMBER

(75) Inventors: Giries Kadis, Jaffa (IL); Wael Salalha, Bet Jan galil (IL); Shunit Petachia, Netanya (IL); Sharon Nagler, Gan Yavna (IL); Marko Richter, Rehovot (IL); Assaf Bendek, Ashdod (IL); Roy Har-Tsvi, Kiryat Motzkin (IL)

(73) Assignee: Hewlett_Packard Indigo B.V., Maastricht (NL)

( * ) Notice: Subject to any disclaimer, the term of this patent is extended or adjusted under 35 U.S.C. 154(b) by 312 days.

(21) Appl. No.: 13/096,610

(22) Filed: Apr. 28, 2011

(65) Prior Publication Data

US 2012/0275836 A1 Nov. 1, 2012

(51) Int. Cl.
*G03G 21/00* (2006.01)

(52) U.S. Cl.
USPC ..... 399/343; 399/345; 399/348

(58) Field of Classification Search
USPC ..... 399/343, 345, 348
See application file for complete search history.

(56) References Cited

U.S. PATENT DOCUMENTS

| | | | | |
|---|---|---|---|---|
| 5,978,630 | A * | 11/1999 | Chang et al. | 399/249 |
| 7,010,259 | B2 * | 3/2006 | Gila et al. | 399/348 |
| 7,991,343 | B2 * | 8/2011 | Izawa et al. | 399/349 |
| 2005/0201785 | A1 * | 9/2005 | Gila et al. | 399/348 |
| 2009/0169278 | A1 * | 7/2009 | Izawa et al. | 399/349 |

* cited by examiner

*Primary Examiner* — G. M. Hyder

(57) ABSTRACT

A method of maintaining a photoconductive member of an image forming apparatus is disclosed. The method includes applying fluid to a photoconductive member to form an image thereon, transferring the fluid from the photoconductive member in the form of the image and providing sponge applicator fluid to respective sponge applicator units. The method also includes squeezing the sponge applicator units to remove at least a portion of the sponge applicator fluid therefrom and sequentially placing each one of the sponge applicator units in contact with the photoconductive member to cool and clean the photoconductive member.

19 Claims, 12 Drawing Sheets

IMAGE FORMING APPARATUS INCLUDING SPONGE APPLICATOR UNITS TO SEQUENTIALLY CONTACT A PHOTOCONDUCTIVE MEMBER

BACKGROUND

Image forming apparatuses such as liquid electrophotography systems include a fluid applicator unit such as binary ink developers to provide charged liquid toner to a latent image on a photoconductive member to form fluid images. The photoconductive member transfers the fluid images therefrom onto a heated intermediate transfer member. Subsequently, the intermediate transfer member transfers the fluid images to media.

BRIEF DESCRIPTION OF THE DRAWINGS

Non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

DETAILED DESCRIPTION

Figure 1:
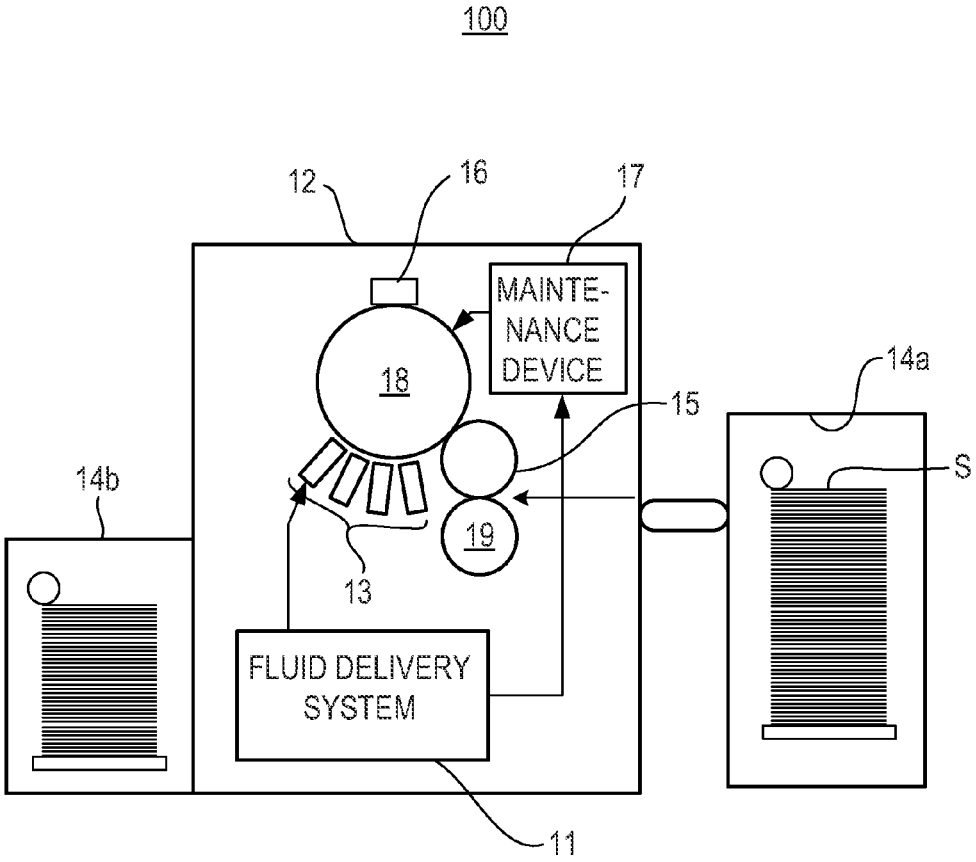
FIG. 1 is a schematic view illustrating a liquid electrophotography system according to an example.

In the following detailed description, reference is made to the accompanying drawings which form a part hereof, and in which is depicted by way of illustration specific examples in which the present disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims.

Image forming apparatuses such as liquid electrophotography systems provide fluid such as liquid toner to a fluid applicator unit such as binary ink developers (BIDs). The liquid toner is charged and is provided to a latent image on a photoconductive member such as a photo imaging member (PIP) to form a fluid image, for example, by BIDs. The photoconductive member, in turn, provides the fluid image to an intermediate transfer member such as a heated intermediate transfer blanket. The heated intermediate transfer blanket transfers the fluid image onto a media and also transfer heat to the photoconductive member. The increased temperature of the photoconductive member may adversely impact the lifespan of the photoconductive member and the charging thereof. Contaminants and/or fluid residue may undesirably remain on the photoconductive member and negatively contribute to printing side effects and reduce the lifespan of the photoconductive member.

In examples, an image forming apparatus includes, among other things, sponge applicator units configured to cool and clean a photoconductive member such that each one of the sponge applicator units sequentially contacts the photoconductive member. Each one of the sponge applicator units sequentially contacts the photoconductive member after the fluid such as liquid toner applied to the photoconductive member is transferred therefrom, for example, in the form of the fluid image. That is, the sequential contact between the respective sponge applicator units and the photoconductive member occurs after the photoconductive member transfers the fluid image to an intermediate transfer member and/or the intermediate transfer member transfers the fluid image onto the media.

In examples, the image forming apparatus also includes spraying units disposed across from the sponge applicator units to provide fields of spray of sponge applicator fluid onto the sponge applicator units. The sponge applicator fluid is applied prior to the contact between the respective sponge applicator unit and the photoconductive member. The sponge applicator units are cooled by the sponge applicator fluid received thereon. The image forming apparatus also includes a squeeze unit configured to squeeze the sponge applicator units prior to the contact between the respective sponge applicator units and the photoconductive member. Thus, the potential for an excessive amount of sponge applicator fluid to be transferred from the squeeze unit to the photoconductive member is reduced. Such sequential contacts by each one of the sponge applicator units with the photoconductive member reduce the potential of printing defects, improper charging, and shortening the lifespan of the photoconductive member.

FIG. 1 is a schematic view illustrating an image forming apparatus such as a liquid electrophotography system (LEP) according to an example. Referring to FIG. 1, a LEP 100 includes an image forming unit 12 that receives a media S from an input unit 14*a* and outputs the substrate S to an output unit 14*b*. The image forming unit 12 includes a fluid applicator unit 13 and a photoconductive member 18 on which images can be formed. The photoconductive member 18 may be charged with a suitable charger (not illustrated) such as a charge roller. Portions of the outer surface of the photoconductive member 18 that correspond to features of the image can be selectively discharged by a laser writing unit 16 to form an electrostatic and/or latent image thereon.

Referring to FIG. 1, the LEP 100 also includes a fluid delivery system 11 to supply fluid including ink such as liquid toner, for example, ElectroInk, trademarked by Hewlett-Packard Company, to a fluid applicator unit 13 such as BIDs. In an example, the fluid delivery system 11 may also supply maintenance fluid (e.g., sponge applicator fluid) such as imaging oil to a maintenance device 17 The maintenance device 17 uses the maintenance fluid to maintain the photoconductive member 18 such as cooling and cleaning the photoconductive member 18. The fluid applicator unit 13 applies the fluid such as liquid toner to the electrostatic and/or latent image to form a fluid image on the photoconductive member 18 to be transferred to an intermediate transfer member (ITM) 15. The ITM 15 is configured to receive the fluid image from the photoconductive member 18, heat the fluid image, and transfer the fluid image to the media S. Heat from the ITM 15 may also transfer to the photoconductive member 18. During the transfer of the fluid image from the ITM 15 to the media S, the media S is pinched between the ITM 15 and an impression member 19. Once the fluid image has been transferred to the media S, the media S can be transported to the output unit 14*b*.

Figure 2:
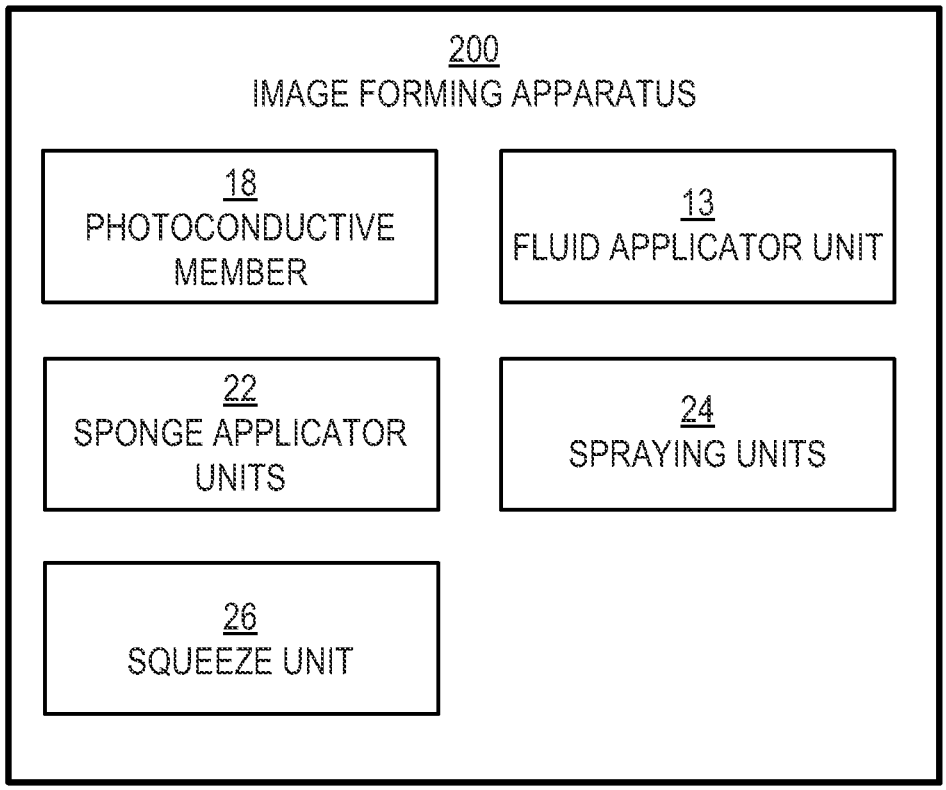
FIG. 2 is a block diagram illustrating an image forming apparatus according to an example.

FIG. 2 is a block diagram illustrating an image forming apparatus according to an example. The image forming apparatus 200 may be a LEP 100. Referring to FIG. 2, in the present example, the image forming apparatus 200 includes a photoconductive member 18, a fluid applicator unit 13, a plurality of sponge applicator units 22, a plurality of spraying units 24, and a squeeze unit 26. The photoconductive member 18 is configured to receive fluid thereon and transfer the fluid in a form of a fluid image therefrom. In an example, the photoconductive member 18 may include a photo imaging plate configured to form a latent image thereon. The fluid applicator unit 13 is configured to apply the fluid including ink such as liquid toner to the photoconductive member 18 to form the fluid image thereon. In an example, the fluid applicator unit 13 may include one BID. In other examples, the fluid applicator unit 13 may include a plurality of BIDs. For example, each BID may correspond to a respective color fluid such as black ink, cyan ink, yellow ink, and magenta ink.

Figure 3:
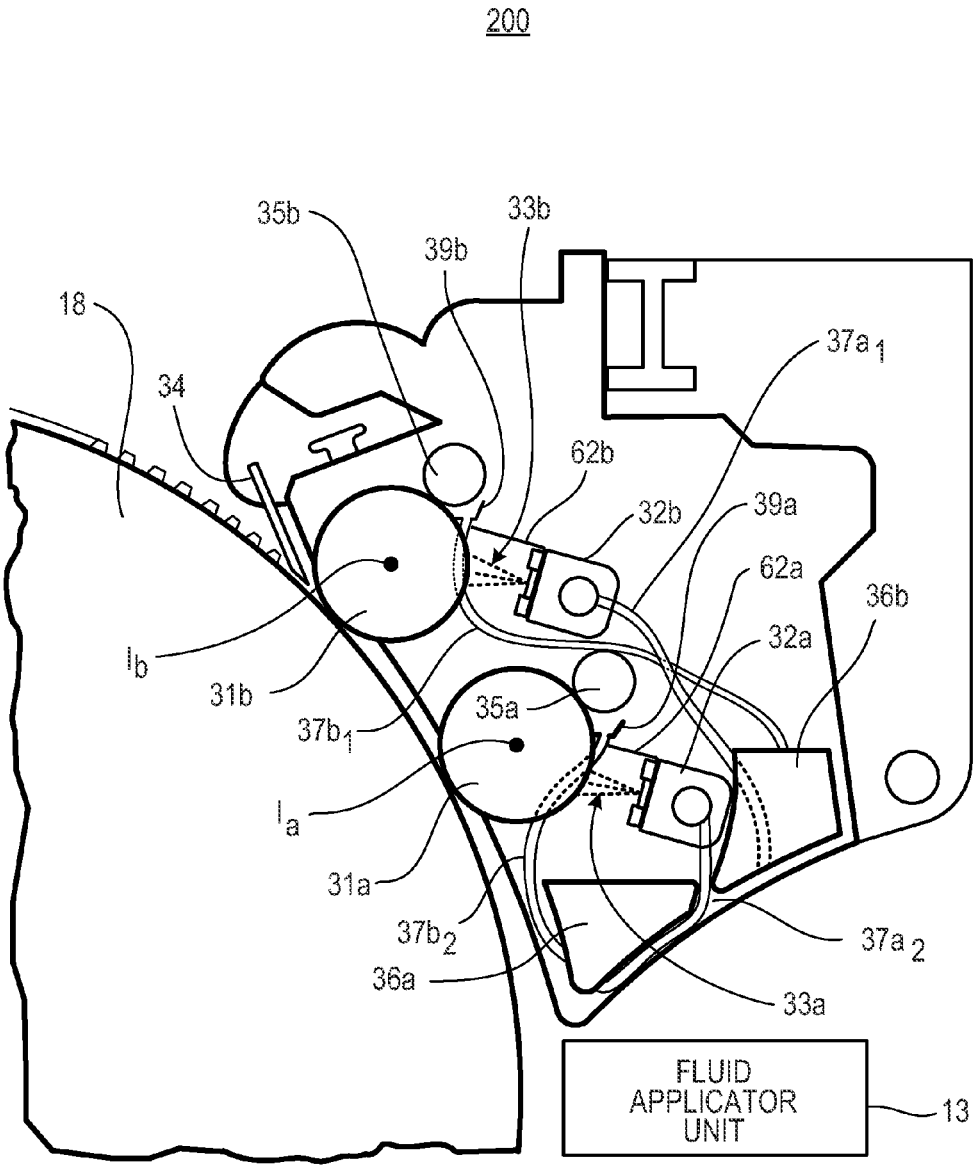
FIG. 3 is a cross-sectional view illustrating a portion of the image forming apparatus of FIG. 2 according to an example.

Referring to FIG. 2, the sponge applicator units 22 are configured to cool and clean the photoconductive member 18. Each one of the sponge applicator units 22 sequentially contacts the photoconductive member 18 after the fluid such as liquid toner is applied to the photoconductive member 18 is transferred therefrom, for example, in the form of the fluid image. That is, the sequential contact between the respective sponge applicator units 22 and the photoconductive member 18 occurs after the photoconductive member 18 transfers the fluid image to an intermediate transfer member 15 and/or the intermediate transfer member 15 transfers the fluid image onto the media. The spraying units 24 are disposed across from the sponge applicator units 22 (FIG. 3). The spraying units 24 are configured to provide fields of spray 33*a* and 33*b* (FIG. 3) of sponge applicator fluid onto the sponge applicator units 22. The sponge applicator fluid is provided to the respective sponge applicator units 22 prior to the sequential contact between the respective sponge applicator units 22 and the photoconductive member 18. The sponge applicator fluid may cool the sponge applicator units 22. Subsequently, the sponge applicator units 22 cooled by the sponge applicator fluid are placed in sequential contact with and, among other things, cool and clean the photoconductive member 18. Thus, fluid residuals remaining on the photoconductive member 18 after the transfer of the fluid image therefrom may be removed.

Referring to FIG. 2, the squeeze unit 26 is configured to squeeze the sponge applicator units 22. That is, the squeeze unit 26 contacts and applies pressure to the sponge applicator units 22 to remove at least a portion of the sponge applicator fluid thereon. Each one of the respective sponge applicator units 22 are squeezed prior to its respective sequential contact with the photoconductive member 18. Thus, an amount of sponge applicator fluid which ultimately is transferred from the sponge applicator units 22 to the photoconductive member 18 is reduced. Accordingly, the potential for the photoconductive member 18 to receive an excessive amount of sponge applicator fluid from the sponge applicator units 22 and inadvertently drip the sponge applicator fluid therefrom is reduced.

FIG. 3 is a cross-sectional view illustrating a portion of the image forming apparatus of FIG. 2 according to an example. Referring to FIGS. 2 and 3, in examples, the image forming apparatus 200 may also include a plurality of fluid storing chambers 36*a* and 36*b*, a plurality of fluid receiving paths $\mathbf{37}a_1$ and $\mathbf{37}b_1$, one or more supply paths $\mathbf{37}a_2$ and $\mathbf{37}b_2$, and a wiping unit 34. The fluid storing chambers 36*a* and 36*b* are configured to receive the sponge applicator fluid removed from the respective sponge applicator units 22. In the present example, the fluid receiving paths $\mathbf{37}a_1$ and $\mathbf{37}b_1$ are configured to transport the respective sponge applicator fluid between the sponge applicator units 22 and the fluid storing chambers 36*a* and 36*b*, respectively. Each one of the fluid storing chambers 36*a* and 36*b* correspond to a respective sponge applicator unit 22. In an example, the respective fluid storing chambers 36*a* and 36*b* may also facilitate transportation of the sponge applicator fluid between the sponge applicator units 22 and the spraying units 24. Consequently, fog and mist formed by the sponge applicator fluid escaping to outside of the image forming apparatus 200 may be reduced.

In an example, each one of the respective fluid receiving paths $\mathbf{37}a_1$ and $\mathbf{37}b_1$ may include a catch basin 39*a* and 39*b* to catch the sponge applicator fluid squeezed from the respective sponge rollers 31*a* and 31*b*. In other examples, the catch basins 39*a* and 39*b* and fluid receiving paths $\mathbf{37}a_1$ and $\mathbf{37}b_1$ may be in a form of shielding members 62*a* and 62*b* disposed between the respective sponge rollers 31*a* and 31*b* and the respective fluid storing chambers 36*a* and 36*b* to direct the squeezed sponge applicator fluid from the respective sponge rollers 36*a* and 36*b* to the respective fluid storing chambers 36*a* and 36*b*. The fluid supply paths $\mathbf{37}a_2$ and $\mathbf{37}b_2$ may be configured to supply sponge applicator fluid to the spraying units 32*a* and 32*b*, respectively. In an example, the fluid supply paths $\mathbf{37}a_2$ and $\mathbf{37}b_2$ may be disposed between the spraying units 32*a* and 32*b* and the fluid storing chambers 36*a* and 36*b*, respectively. In an example, the fluid storing chambers 36*a* and 36*b* may filter the received sponge applicator fluid and provide the filtered sponge applicator fluid back to the respective spraying units 32*a* and 32*b*.

Alternatively, one fluid supply path may supply the sponge applicator fluid to the spraying units 22. For example, the spraying units 32*a* and 32*b* may be integrally formed having a common supply inlet and/or in fluid communication with each other. The one supply path may directly or indirectly supply the sponge applicator fluid from the fluid storing chambers 36*a* and 36*b*. For example, a fluid tank (not illustrated) of the fluid delivery system 11 (FIG. 1) may receive the sponge applicator fluid from the fluid storing chambers 36*a* and 36*b* and provide it to spraying units 22 through the one supply path. Accordingly, one fluid supply path may transport the sponge applicator fluid from the respective fluid storing chambers 36*a* and 36*b* to the common supply inlet for both spraying units 32*a* and 32*b*.

Referring to FIGS. 2 and 3, the wiping unit 34 is configured to level the sponge application fluid on the photoconductive member 18 to form an even fluid thickness thereof. For example, sponge applicator fluid on the photoconductive member 18 is wiped by the wiping unit 34 after the sequential contact between the sponge applicator units 22 and the photoconductive member 18. The photoconductive member 18 may be wiped before it is recharged for a new image forming cycle. The wiper unit 34 may include a blade such as a licking deformable blade. In the present example, the licking deformable blade may be spaced apart from the photoconductor member 18 and configured to remove access sponge applicator fluid from the photoconductive member 18 to maintain an even fluid thickness thereof. The photoconductive member 18 having the sponge applicator fluid thereon with the even fluid thickness may then be charged. The licking deformable blade may maintain the even fluid thickness while allowing fluid particles to pass thereby. The sponge applicator fluid may include imaging oil such as Isopar trademarked by Exxon Corporation.

Referring to FIGS. 2 and 3, in an example, the sponge applicator units 22 may include a first sponge roller 31*a* movable between a sponge contact state and a sponge non-contact state with the photoconductive member 18. The sponge contact state is a state in which a respective sponge roller 31*a* and 31*b* is in contact with the photoconductive member 18. The sponge non-contact state is a state in which the respective sponge roller 31*a* and 31*b* is not in contact with the photoconductive member 18. In an example, each one of the first sponge roller 31*a* and the second sponge roller 31*b* may form respective nip lengths with the photoconductive member 18. The respective nip lengths may be predetermined and correspond to an amount of cooling to be applied to the photoconductive member 18. In the present example, the first sponge roller 31*a* is configured to rotate about a first longitudinal axis I, (FIG. 4) therein to cool and clean the photoconductive member 18 when placed in the sponge contact state therewith as illustrated in FIG. 5B. For example, the contact between the photoconductive member 18 and the first sponge roller 31*a* previously cooled with sponge applicator fluid cools the photoconductive member 18. Additionally, the force of the first sponge roller 31*a* in contact with and rotating against the photoconductive member 18 cleans the photoconductive member 18 by forcing fluid residue, or the like, therefrom.

In the present example, the second sponge roller 31*b* is movable between the sponge contact state and the sponge non-contact state with respect to the photoconductive member 18. The second sponge roller 31*b* is configured to rotate about a second longitudinal axis $l_b$ (FIG. 4) therein to cool and clean the photoconductive member 18 when placed in the sponge contact state therewith as illustrated in FIG. 5C. For example, the contact between the photoconductive member 18 and the second sponge roller 31*b* previously cooled with sponge applicator fluid further cools and cleans the photoconductive member 18. Additionally, the force of the second sponge roller 31*b* in contact with and rotating against the photoconductive member 18 cleans the photoconductive member 18 by forcing fluid residue, or the like, therefrom. In the present example, the sequential contact of the sponge applicator units 22 and the photoconductor member 18 include a first sponge roller 31*a* initially being placed in a sponge contact state while the second sponge roller 31*b* is in (e.g., remains in) the sponge non-contact state. Subsequently, the second sponge roller 31*b* may be placed in the sponge contact state while the first sponge roller 31*a* is in (e.g., remains in) the sponge contact state. Alternatively, in the subsequent stage, the second sponge roller 31*b* may be placed in the sponge contact state while the first sponge roller 31*a* is in the sponge non-contact state.

In other examples, the sequential contact of the sponge applicator units 22 and the photoconductor member 18 may include the second sponge roller 31*b* initially being placed in the sponge contact state while the first sponge roller 31*a* is in the sponge non-contact state. Subsequently, the first sponge roller 31*a* may be placed in the sponge contact state while the second sponge roller 31*b* is in (e.g., remains in) the sponge contact state.

Referring to FIGS. 2 and 3, the squeeze unit 26 may include a first squeegee roller 35*a* and a second squeegee roller 35*b*. The first squeegee roller 35*a* is configured to squeeze the first sponge roller 31*a* to remove at least a portion of the sponge applicator fluid provided thereto by the first set of spraying units 32*a*. The second squeegee roller 35*b* is configured to squeeze the second sponge roller 31*b* to remove at least a portion of the sponge applicator fluid provided thereto by the second set of spraying units 32*b*. In the present example, the first squeegee roller 35*a* and the second squeegee roller 35*b* are in constant contact with the first sponge roller 31*a* and the second sponge roller 31*b*, respectively.

In other examples, the first squeegee roller 35*a* and the second squeegee roller 35*b* may be in movable contact with the respective sponge rollers 31*a* and 31*b*. That is, each one of the squeegee rollers 35*a* and 35*b* may selectively move in and out of contact with the respective sponge rollers 31*a* and 31*b*. For example, the first squeegee roller 35*a* may move into contact with the first sponge roller 31*a* after sponge application fluid is applied thereto and before the first sponge roller 31*a* contacts the photoconductive member 18. The second squeegee roller 35*b* may move into contact with the second sponge roller 31*b* after sponge application fluid is applied thereto and before the second sponge roller 31*b* contacts the photoconductive member 18.

Figure 4:
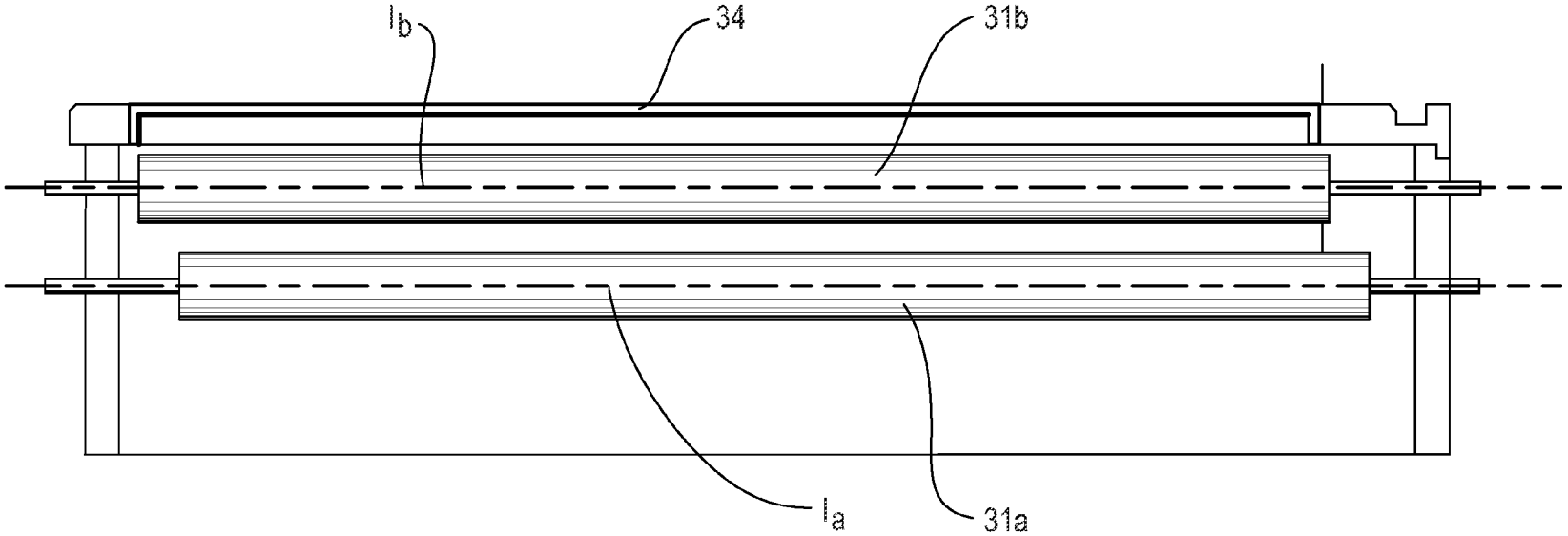
FIG. 4 is an elevational view illustrating sponge rollers and a wiping member of the image forming apparatus of FIG. 3 according to an example.

FIG. 4 is an elevational view illustrating sponge rollers and the wiping unit of the image forming apparatus of FIG. 3 according to an example. Referring to FIG. 4, in an example, a first sponge roller 31*a* has a first longitudinal axis $l_a$ therein and is configured to rotate thereabout. The second sponge roller 31*b* has a second longitudinal axis $l_b$ therein and is configured to rotate thereabout. In the present example, the wiper unit 34 is parallel to and extends along a longitudinal axis (not illustrated) of the photoconductive member 18. The wiping unit 34 and/or blade thereof may extend across approximately the entire length of the photoconductive member 18. In examples, the wiper unit 34 is disposed across from and extends parallel to at least one of the longitudinal axis $l_a$ and $l_b$ of the respective sponge rollers 31*a* and 31*b*.

Figure 5A:
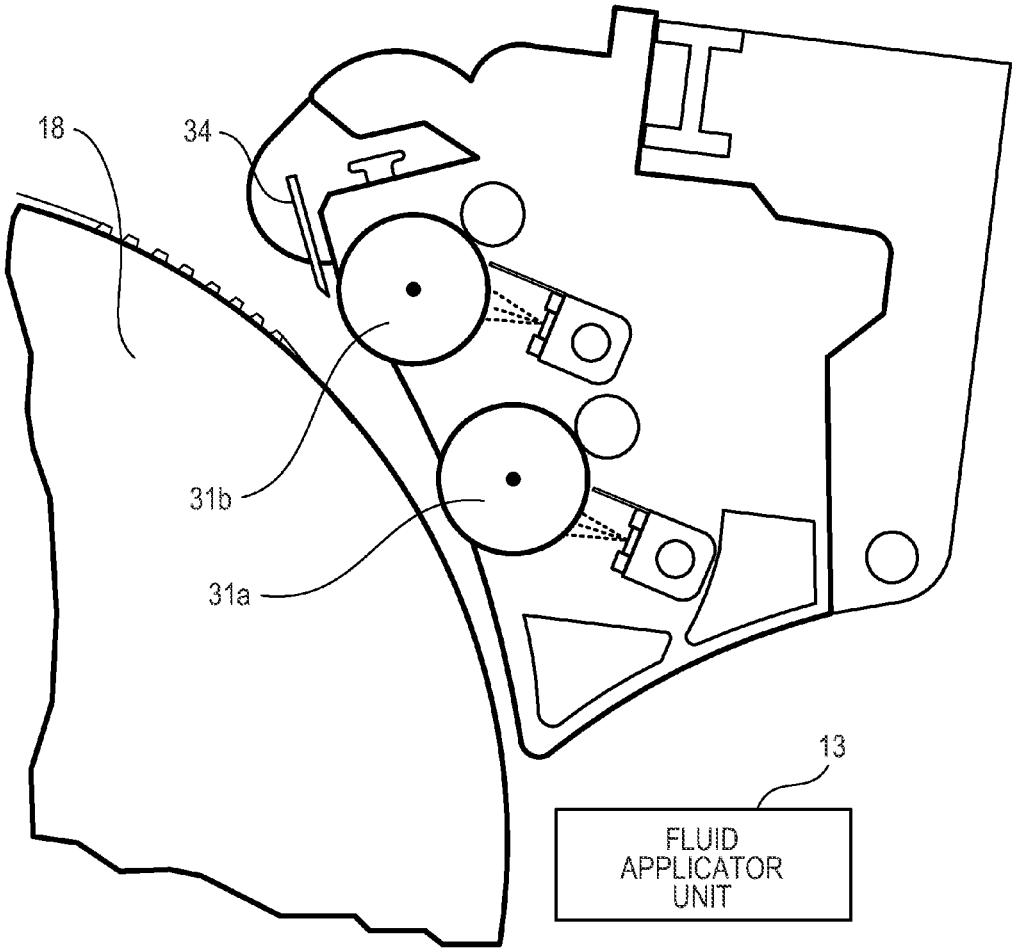
FIGS. 5A-5C are schematic diagrams illustrating sequential engagement states of the respective sponge rollers of the image forming apparatus of FIG. 3 according to an example.
Figure 5B:
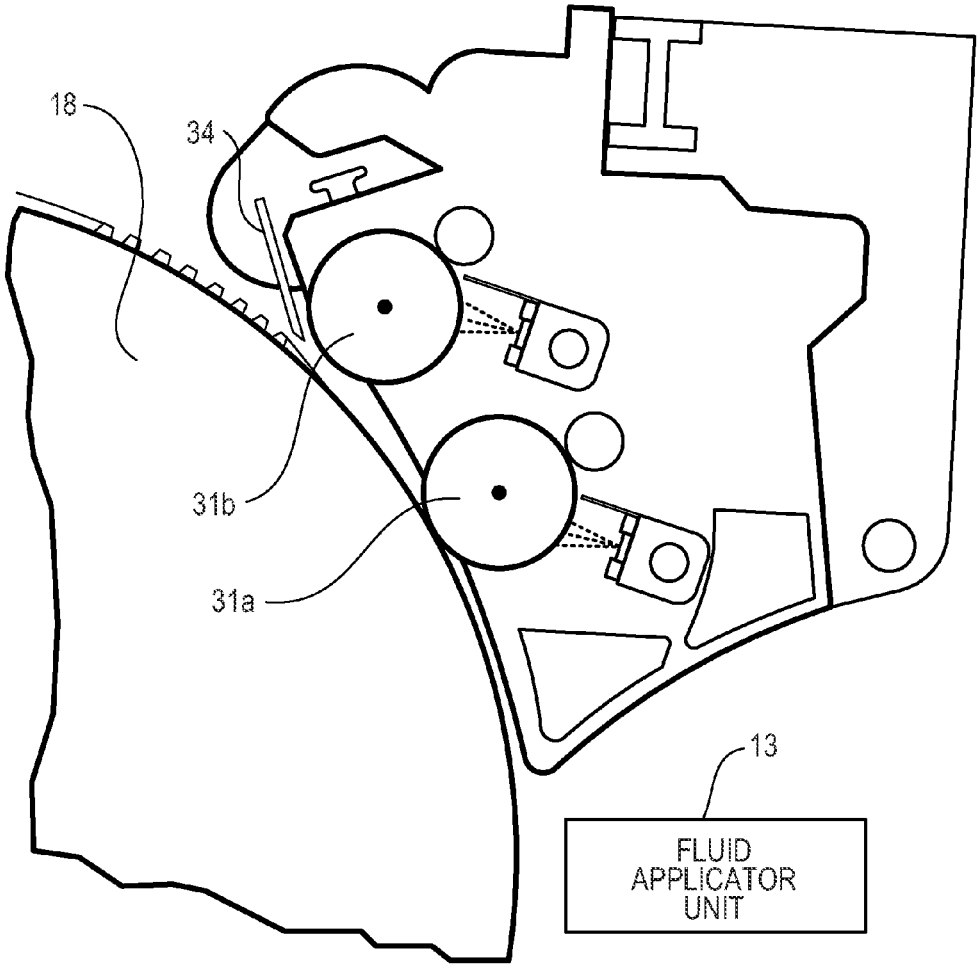
Figure 5C:
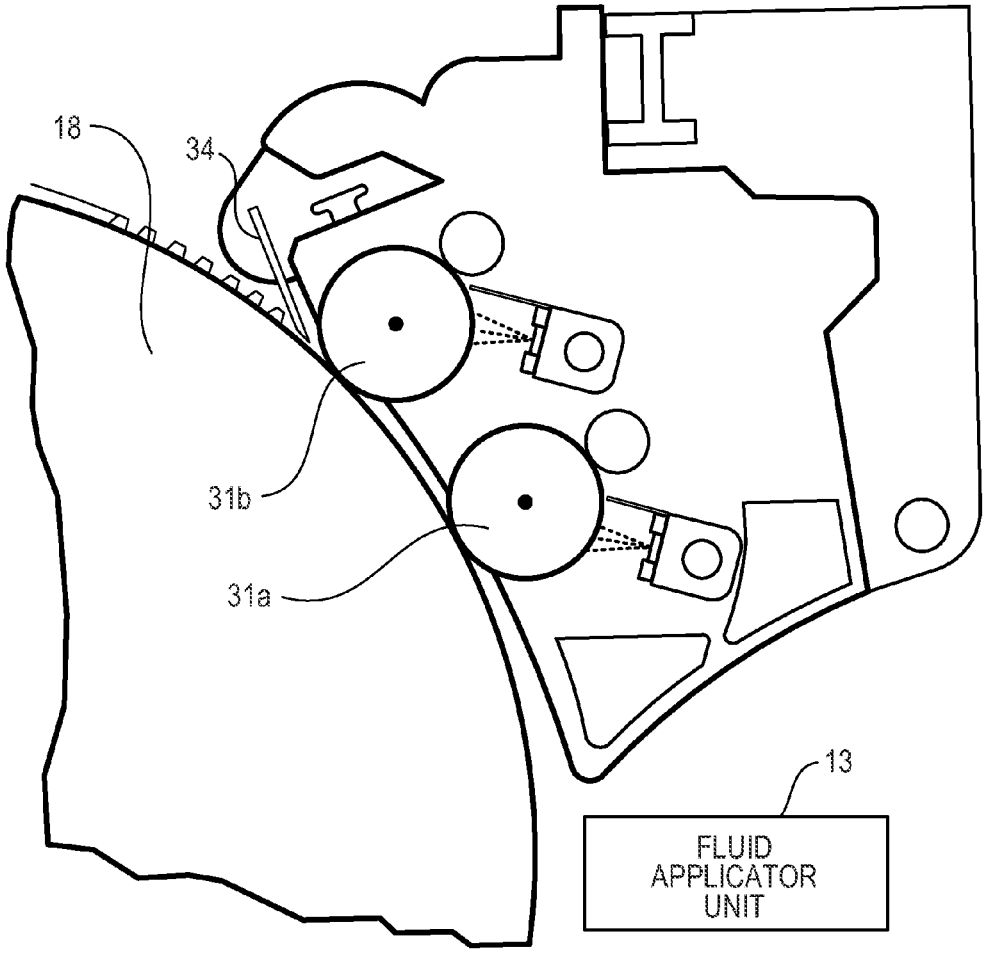

FIGS. 5A-5C are schematic diagrams of sequential engagement states of the respective sponge rollers of the image forming apparatus of FIG. 3 according to an example. Referring to FIG. 5A, the respective sponge rollers 31*a* and 31*b* are in a disengagement state. That is, both the first sponge roller 31*a* and the second sponge roller 31*b* are in a sponge non-contact state with respect to the photoconductive member 18. Referring to FIG. 5B, the respective sponge rollers 31*a* and 31*b* are in a semi-engagement state. That is, the first sponge roller 31*a* is in a sponge contact state and the second sponge roller 31*b* is in a sponge non-contact state with respect to the photoconductive member 18. Alternatively, the semi-engagement state may include the first sponge roller 31*a* being in a sponge non-contact state and the second sponge roller 31*b* being in a sponge contact state with respect to the photoconductive member 18. Referring to FIG. 5C, the respective sponge rollers 31*a* and 31*b* are in a full engagement state. That is, both the first sponge roller 31*a* and the second sponge roller 31*b* are in a sponge contact state with respect to the photoconductive member 18.

Figure 5D:
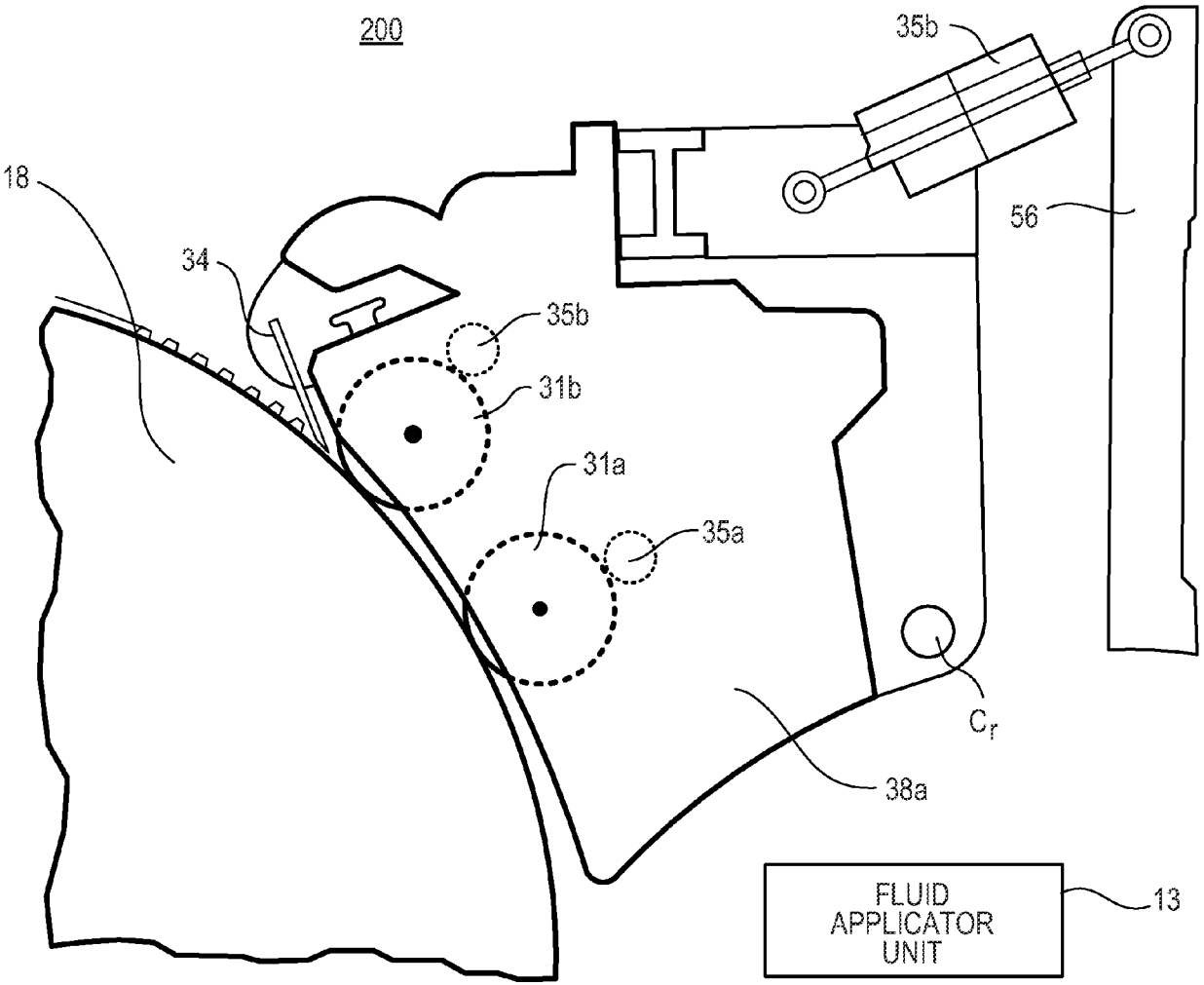
FIG. 5D is a side view of a maintenance assembly frame of the image forming apparatus of FIG. 3 according to an example.

FIG. 5D is a side view including a maintenance assembly frame of the image forming apparatus of FIG. 3 according to an example. Referring to FIG. 5D, in an example, the respective sponge rollers 31*a* and 31*b* may be rotatably connected to a maintenance assembly frame 38*a*. The maintenance assembly frame 38*a* may be movable with respect to the photoconductive member 18 to place the first sponge roller 31*a* and the second sponge roller 31*b* in the various sequential engagement states as illustrated in FIGS. 5A, 5B and 5C. The maintenance assembly frame 38*a* may be removably installed in the image forming apparatus 200 and engage with a rotary engagement system 55 to move at least a portion of the maintenance assembly frame 38*a* toward and away from the photoconductive member 18. In an example, the maintenance assembly frame 38*a* may pivot about a rotational center $c_r$ thereof. In the present example, the distances between the rotational center $c_r$ of the maintenance assembly frame 38*a* and longitudinal axis $l_a$ and $l_b$ of the respective sponge rollers 31*a* and 31*b* are different to enable the various sequential engagement states between the respective sponge 31*a* and 31*b* and the photoconductive member 18.

Referring to FIG. 5D, the rotary engagement system 55 may include double pneumatic cylinders having multiple stages, for example, to correspond with the respective engagement states of the sponge rollers 31*a* and 31*b*. One cylinder of the rotary engagement system 55 may be connected to a main frame 56 of the image forming apparatus 200 and the other cylinder may engage directly or indirectly with the movable maintenance assembly frame 38*a*. The rotary engagement system 55 may selectively place the maintenance assembly frame 38*a* into the disengagement state (FIG. 5A), semi-engagement state (FIG. 5B), and full engagement state (FIG. 5C). In examples, the respective sponge rollers 31*a* and 31*b*, squeegee rollers 35*a* and 35*b*, spraying units 32*a* and 32*b*, fluid storage chambers 36*a* and 36*b*, fluid receiving paths 37$a_1$ and 37$b_1$, and fluid supply paths 37$a_2$ and 37$b_2$ may be connected to and/or contained within the maintenance assembly frame 38*a*.

Figure 6:
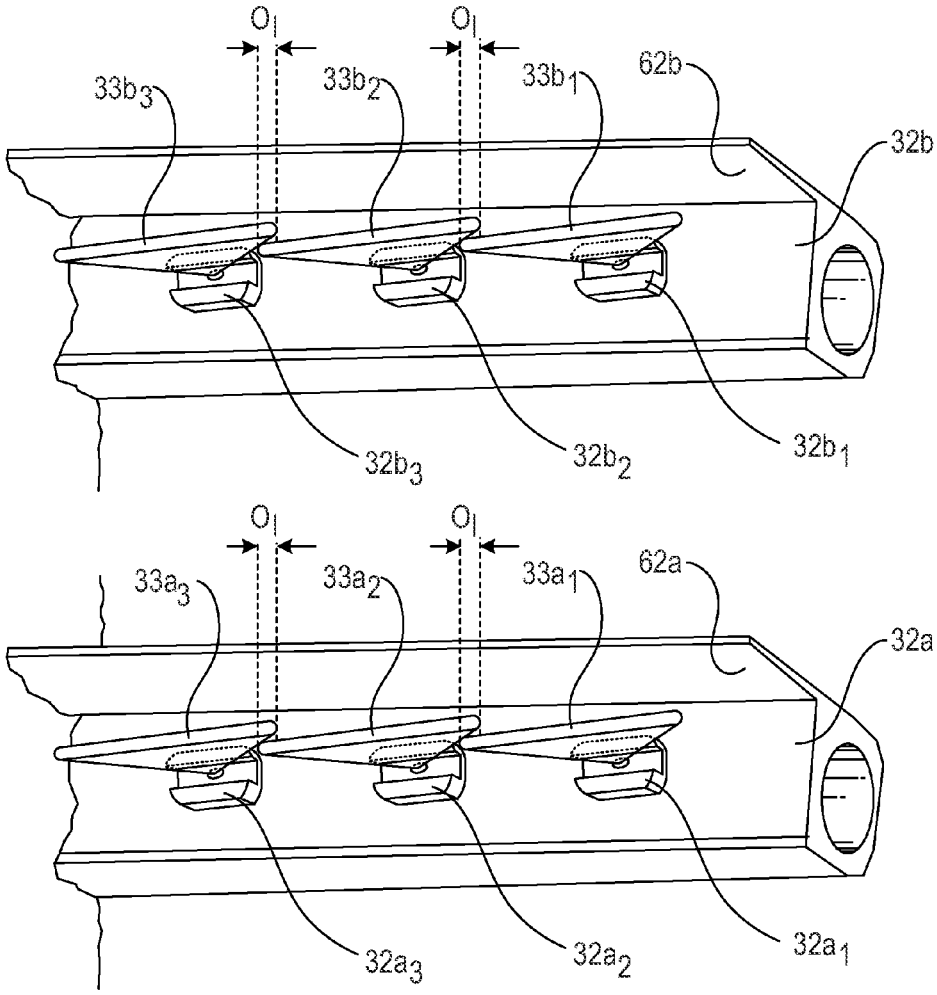
FIG. 6 is a perspective view illustrating a portion of spraying units of the image forming apparatus of FIG. 3 according to an example.

FIG. 6 is a perspective view illustrating a portion of spraying units of the image forming apparatus of FIG. 3 according to an example. Referring to FIGS. 3, 4 and 6, in an example, the spraying units 22 include a first set of spraying units 32*a* and a second set of spraying units 32*b*. The first set of spraying units 32*a* may be arranged across from and parallel to the first longitudinal axis I, of the first sponge roller 31*a*. The first set of spraying units 32*a* is configured to provide fields of spray 33*a* of sponge applicator fluid onto the first sponge roller 31*a* such that portions of respective fields of spray 33$a_1$, 33$a_2$ and 33$a_3$ of adjacent spraying units 32$a_1$, 32$a_2$ and 32$a_3$ form overlap regions $o_l$ with each other. The second set of spraying units 32*b* is arranged across from and parallel to the second longitudinal axis $l_b$ of the second sponge roller 31*b*. The second set of spraying units 32*b* is configured to provide fields of spray 33*b* of sponge applicator fluid onto the second sponge roller 31*b* such that portions of respective fields of spray 33$b_1$, 33$b_2$, and 33$b_3$ of adjacent spraying units form overlap regions $o_l$ with each other.

Referring to FIGS. 3, 4 and 6, in an example, the first set of spraying units 32*a* and the second set of spraying units 32*b* may include respective shielding members 62*a* and 62*b*. The respective shielding members 62*a* and 62*b* are configured to shield each one of the sponge rollers 35*a* and 35*b* from passing contaminants, or the like, from one sponge roller to the other sponge roller. In an example, the shielding members 62*a* and 62*b* may also form a shielding area proximate to an area in which the respective sponge rollers 31*a* and 31*b* and the respective squeegee rollers 35*a* and 35*b* contact each other to reduce an amount of fog and mist from escaping therefrom. In yet another example, the shielding members 62*a* and 62*b* may be elongated and extend from proximate to the respective sponge rollers 31*a* and 31*b* to the respective fluid storing chambers 36*a* and 36*b*. In this capacity, the shielding members 62*a* and 62*b* may replace the fluid receiving members 37$a_1$ and 37$b_1$ to direct the squeezed sponge applicator fluid from the respective sponge rollers 31*a* and 31*b* to the respective fluid storing chambers 36*a* and 36*b*.

Figure 7:
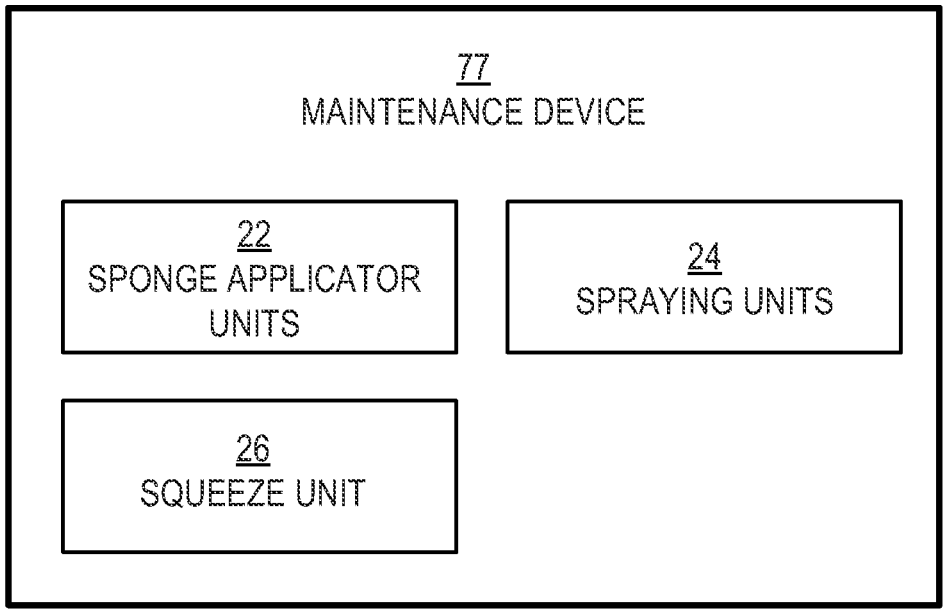
FIG. 7 is a block diagram illustrating a maintenance device usable with an image forming apparatus according to an example.
Figure 8:
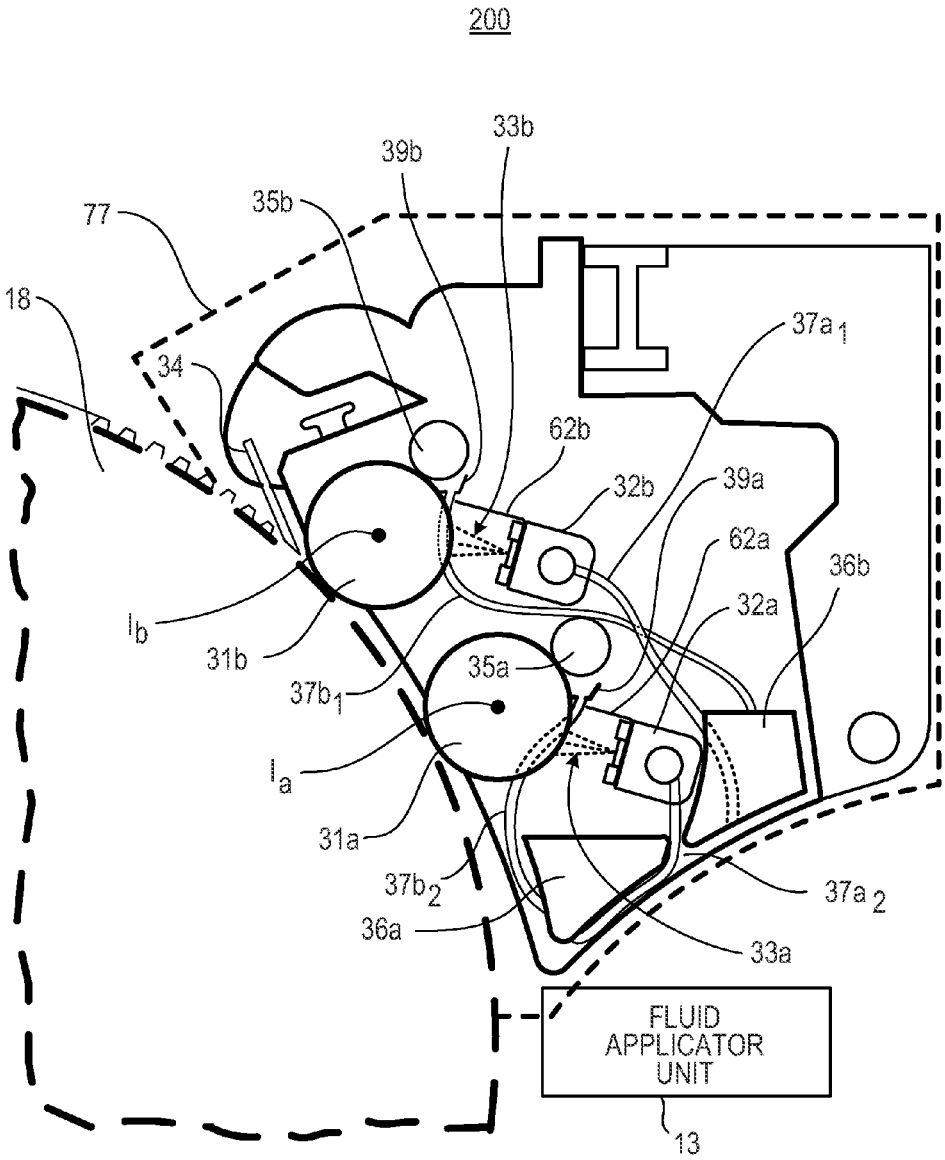
FIG. 8 is a cross-sectional view illustrating the maintenance device of FIG. 7 according to an example.

FIG. 7 is a block diagram illustrating a maintenance device and a wiping unit according to an example. FIG. 8 is a cross-sectional view illustrating a maintenance device according to an example. The maintenance device 77 is usable with an image forming apparatus 200 (FIG. 2). The image forming apparatus 200 includes a photoconductive member 18 to receive fluid thereon and transfer the fluid therefrom in a form of an image. The image forming apparatus 200 also includes a fluid applicator unit 13 to apply the fluid including ink such as liquid toner to the photoconductive member 18. Referring to FIGS. 7 and 8, in the present example, the maintenance device 77 includes a plurality of sponge applicator units 22, a plurality of spraying units 24, and a squeeze unit 26. The sponge applicator units 22 are configured to clean and cool the photoconductive member 18 such that each one of the sponge applicator units 22 sequentially contacts the photoconductive member 18 after the fluid applied to the photoconductive member 18 is transferred therefrom. For example, the sequential contact between the respective sponge applicator units 22 and the photoconductive member 18 occurs after the photoconductive member 18 transfers the fluid image to an intermediate transfer member 15 and/or the intermediate transfer member 15 transfers the fluid image onto the media.

Referring to FIG. 7, the spraying units 24 are disposed across from the sponge applicator units 22. The spraying units 24 are configured to provide fields of spray 33*a* and 33*b* of sponge applicator fluid onto the sponge applicator units 22 prior to the sequential contact between the sponge applicator units 22 and the photoconductive member 18. The squeeze unit 26 is configured to squeeze the sponge applicator units 22. The sponge applicator units 22 are squeezed prior to the sequential contact between the sponge applicator units 22 and the photoconductive member 18.

Referring to FIG. 8, the maintenance device 77 may also include a plurality of fluid storing chambers 36*a* and 36*b*, a plurality of fluid receiving paths 37$a_1$ and 37$b_1$, one or more fluid supply paths 37$a_2$ and 37$b_2$, a wiping unit 34, and a maintenance assembly frame 38*a* as previously disclosed with respect to the image forming apparatus of FIG. 3. In examples, the sponge applicator units 22 may include a first sponge roller 31*a* and a second sponge roller 31*b*, the spraying units 24 may include a first set of spraying units 32*a* and a second set of spraying units 32*b*, the squeeze unit 26 may include a first squeegee roller 35*a* and a second squeegee roller 35*b*, and sets of the spraying units 32*a* and 32*b* may include shielding members 62*a* and 62*b* as previously disclosed with respect to the image forming apparatus 200 of FIG. 3.

Figure 9:
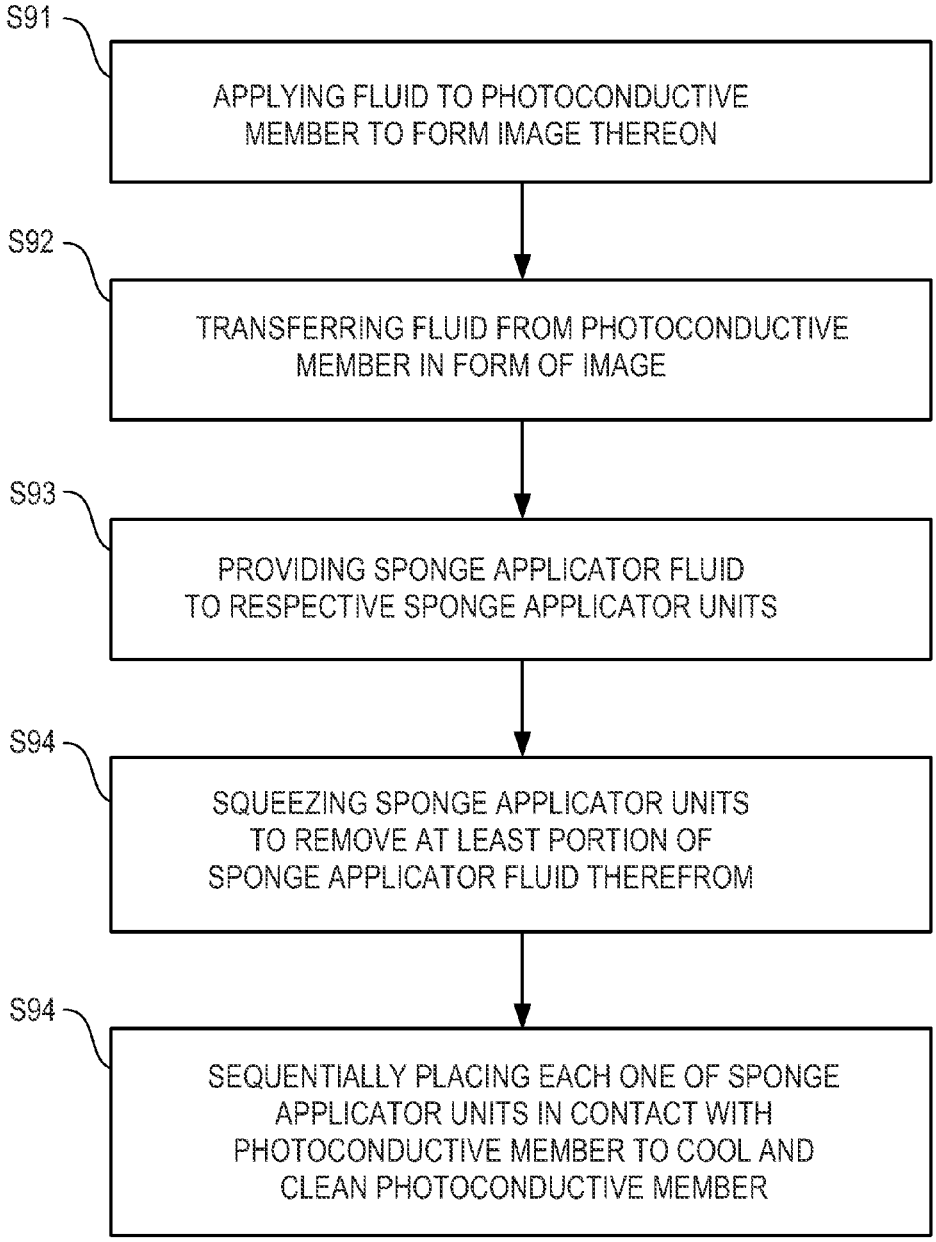
FIG. 9 is a flowchart illustrating a method of maintaining a photoconductive member of an image forming apparatus according to an example.

FIG. 9 is a flowchart illustrating a method of maintaining a photoconductive member of an image forming apparatus according to an example. Referring to FIG. 9, in block S91, fluid is applied to a photoconductive member to form an image thereon. In block S92, the fluid is transferred from the photoconductive member in the form of the image. In block S93, sponge applicator fluid is provided to respective sponge applicator units. In an example, the sponge applicator fluid includes imaging oil. In an example, providing the sponge applicator fluid to respective sponge applicator units may include providing fields of spray of the sponge applicator fluid onto the sponge applicator units by each one of a plurality of spraying units disposed across from the sponge applicator units.

In an example, the respective sponge applicator units may include a first sponge roller and a second sponge roller. The first sponge roller may be movable between a sponge contact state and a sponge non-contact state with the photoconductive member. The first sponge roller may be configured to rotate about a first longitudinal axis therein to cool and clean the photoconductive member when placed in the sponge contact state therewith. The second sponge roller may be movable between the sponge contact state and the sponge non-contact state with the photoconductive member. The second sponge roller may be configured to rotate about a second longitudinal axis therein to cool and clean the photoconductive member when placed in the sponge contact state therewith.

In an example, providing the sponge applicator fluid to respective sponge applicator units includes providing fields of spray of the sponge applicator fluid onto the first sponge roller by a first set of spraying units arranged in a longitudinal direction across from the first sponge roller. Portions of respective fields of spray of adjacent spraying units of the first set of spraying units 32 form overlap regions with each other. Providing the sponge applicator fluid to respective sponge applicator units may also include providing fields of spray of the sponge applicator fluid onto the second sponge roller by a second set of spraying units arranged in a longitudinal direction across from the second sponge roller. Portions of respective fields of spray of adjacent spraying units of the second set of spraying units 32*b* form overlap regions with each other.

In block S94, the sponge applicator units are squeezed to remove at least a portion of the sponge applicator fluid therefrom. In block S95, each one of the sponge applicator units is sequentially placed in contact with the photoconductive member to cool and clean the photoconductive member. In examples, the method may further include wiping the sponge applicator fluid on the photoconductive member to level the sponge application fluid thereon to form an even fluid thickness thereof after sequentially placing each one of the sponge applicator units in contact with the photoconductive member. The method may also include transporting the at least a portion of the sponge applicator fluid removed from each one of the sponge applicator units to a respective one of a plurality of fluid storing chambers.

The present disclosure has been described using non-limiting detailed descriptions of examples thereof and is not intended to limit the scope of the present disclosure. It should be understood that features and/or operations described with respect to one example may be used with other examples and that not all examples of the present disclosure have all of the features and/or operations illustrated in a particular figure or described with respect to one of the examples. Variations of examples described will occur to persons of the art. Furthermore, the terms "comprise," "include," "have" and their conjugates, shall mean, when used in the present disclosure and/or claims, "including but not necessarily limited to."

It is noted that some of the above described examples may include structure, acts or details of structures and acts that may not be essential to the present disclosure and are intended to be exemplary. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. A method of maintaining a photoconductive member of an image forming apparatus, the method comprising:

applying fluid to a photoconductive member to form an image thereon;

transferring the fluid from the photoconductive member in the form of the image;

providing fields of spray of sponge applicator fluid onto the sponge applicator units by each one of a plurality of spraying units disposed across from each one of the respective sponge applicator units such that portions of the respective fields of spray of adjacent spraying units form overlap regions with each other;

squeezing the sponge applicator units to remove at least a portion of the sponge applicator fluid therefrom; and sequentially bringing in each one of the sponge applicator units in contact with the photoconductive member from a non-contact state to cool and clean the photoconductive member.

2. The method according to claim 1, further comprising:

removing from the photoconductive member at least a portion of the sponge applicator fluid after sequentially placing each one of the sponge applicator units in contact with the photoconductive member; and transporting the at least a portion of the sponge applicator fluid removed from each one of the sponge applicator units to a respective one of a plurality of fluid storing chambers.

3. The method according to claim 1, wherein the respective sponge applicator units comprise:

a first sponge rover movable between a sponge contact state and a sponge non-contact state with the photoconductive member, the first sponge roller configured to rotate about a first longitudinal axis therein to cool and dean the photoconductive member when placed in the sponge contact state therewith; and a second sponge roller movable between the sponge contact state and the sponge non-contact state with the photoconductive member, the second sponge roller configured to rotate about a second longitudinal axis therein to cool and clean the photoconductive member when placed in the sponge contact state therewith.

4. The method according to claim 3, wherein the providing fields of spray of the sponge applicator fluid onto the sponge applicator units by each one of a plurality of spraying units disposed across from the sponge applicator units further comprises:

providing fields of spray of the sponge applicator fluid onto the first sponge roller by a first set of spraying units arranged across from the first sponge roller such that portions of respective fields of spray of adjacent spraying units form overlap regions with each other; and providing fields of spray of the sponge applicator fluid onto the second sponge roller by a second set of spraying units arranged across from the second sponge roller such that portions of respective fields of spray of adjacent spraying units form overlap regions with each other.

5. The method according to claim 1, wherein the sponge applicator fluid comprises imaging oil and the image forming apparatus comprises a liquid electrophotography system.

6. A maintenance device usable with an image forming apparatus having a photoconductive member to receive and transfer fluid therefrom in a form of an image and a fluid applicator unit to apply the fluid to the photoconductive member, the maintenance device comprising:

a plurality of sponge applicator units configured to clean and cool the photoconductive member such that each one of the sponge applicator units is sequentially brought into contact with the photoconductive member from a non-contact state after the fluid applied to the photoconductive member is transferred therefrom;

a plurality of spraying units disposed across from each one of the sponge applicator units, each one of the spraying units configured to provide fields of spray of sponge applicator fluid onto the sponge applicator units such that portions of the respective fields of spray of adjacent spraying units form overlap regions with each other prior to the sequential contact between the sponge applicator units and the photoconductive member; and a squeeze unit configured to squeeze the sponge applicator units such that the sponge applicator units are squeezed prior to the sequential contact between the sponge applicator units and the photoconductive member.

7. The maintenance device according to claim 6, wherein sponge applicator units comprise:

a first sponge rover movable between a sponge contact state and a sponge non-contact state with the photoconductive member, the first sponge roller configured to rotate about a first longitudinal axis therein to cool and clean the photoconductive member when placed in the sponge contact state therewith; and a second sponge roller movable between the sponge contact state and the sponge non-contact state with the photoconductive member, the second sponge roller configured to rotate about a second longitudinal axis therein to cool and clean the photoconductive member when placed in the sponge contact state therewith.

8. The maintenance device according to claim 7, wherein the spraying units comprise:

a first set of spraying units arranged across from the first sponge roller, the first set of spraying units configured to provide fields of spray of sponge applicator fluid onto the first sponge roller such that portions of respective fields of spray of adjacent spraying units form overlap regions with each other; and a second set of spraying units arranged across from the second sponge roller, the second set of spraying units configured to provide fields of spray of sponge applicator fluid onto the second sponge roller such that portions of respective fields of spray of adjacent spraying units form overlap regions with each other.

9. The maintenance device according to claim 8, wherein the squeeze unit comprises:

a first squeegee roller configured to squeeze the first sponge roller to remove at least a portion of the sponge applicator fluid provided thereto by the first set of spraying units; and a second squeegee roller configured to squeeze the second sponge roller to remove at least a portion of the sponge applicator fluid provided thereto by the second set of spraying units.

10. The maintenance device according to claim 6, further comprising:

a plurality of fluid storing chambers configured to receive the sponge applicator fluid from the sponge applicator units, respectively;

a plurality of fluid receiving paths configured to transport the respective sponge applicator fluid between the sponge applicator units and the fluid storing chambers, respectively; and a wiping unit configured to level the sponge application fluid on the photoconductive member to form an even fluid thickness thereof after the sequential contact between the sponge applicator units and the photoconductive member.

11. The maintenance device according to claim 10, wherein the wiper unit comprises:

a licking deformable blade configured to remove access sponge applicator fluid from the photoconductive member to maintain an even fluid thickness thereof while allowing fluid particles to pass thereby.

12. The maintenance device according to claim 6, wherein the sponge applicator fluid comprises:

imaging oil.

13. An image forming apparatus, comprising:

a photoconductive member configured to receive fluid thereon and transfer the fluid in a form of an image therefrom;

a fluid applicator unit configured to apply the fluid to the photoconductive member to form the image thereon;

a plurality of sponge applicator units configured to cool and clean the photoconductive member such that each one of the sponge applicator units is sequentially brought into contact with the photoconductive member from a non-contact state after the fluid applied to the photoconductive member is transferred therefrom;

a plurality of spraying units disposed across from each one of the sponge applicator units, each one of the spraying units configured to provide fields of spray of sponge applicator fluid onto the sponge applicator units such that portions of the respective fields of spray of the adjacent spraying units form overlap regions with each other prior to the sequential contact between the sponge applicator units and the photoconductive member; and a squeeze unit configured to squeeze the sponge applicator units such that the sponge applicator units are squeezed prior to the sequential contact between the sponge applicator units and the photoconductive member.

14. The image forming apparatus according to claim 13, wherein sponge applicator units comprise:

a first sponge roller movable between a sponge contact state and a sponge non-contact state with the photoconductive member, the first sponge roller configured to rotate about a first longitudinal axis therein to cool and clean the photoconductive member when placed in the sponge contact state therewith; and a second sponge roller movable between the sponge contact state and the sponge non-contact state with the photoconductive member, the second sponge roller configured to rotate about a second longitudinal axis therein to cool and clean the photoconductive member when placed in the sponge contact state therewith.

15. The image forming apparatus according to claim 14, wherein the spraying units comprise:

a first set of spraying units arranged across from the first sponge roller, the first set of spraying units configured to provide fields of spray of sponge applicator fluid onto the first sponge roller such that portions of respective fields of spray of adjacent spraying units form overlap regions with each other; and a second set of spraying units arranged across from the second sponge roller, the second set of spraying units configured to provide fields of spray of sponge applicator fluid onto the second sponge roller such that portions of respective fields of spray of adjacent spraying units form overlap regions with each other.

16. The image forming apparatus according to claim 15, wherein the squeeze unit comprises:

a first squeegee roller configured to squeeze the first sponge roller to remove at least a portion of the sponge applicator fluid provided thereto by the first set of spraying units; and a second squeegee roller configured to squeeze the second sponge roller to remove at least a portion of the sponge applicator fluid provided thereto by the second set of spraying units.

17. The image forming apparatus according to claim 13, further comprising:

a plurality of fluid storing chambers configured to receive the respective sponge applicator fluid from the sponge applicator units, respectively;

a plurality of fluid receiving paths configured to transport the respective sponge applicator fluid between the sponge applicator units and the fluid storing chambers, respectively; and a wiping unit configured to level the sponge application fluid on the photoconductive member to form an even fluid thickness thereof after the sequential contact between the sponge applicator units and the photoconductive member.

18. The image forming apparatus according to claim 17, wherein the wiper unit comprises:

a licking deformable blade configured to remove access sponge applicator fluid from the photoconductive member to maintain an even fluid thickness thereof while allowing fluid particles to pass thereby.

19. The image forming apparatus according to claim 13, wherein the sponge applicator fluid comprises imaging oil and the image forming apparatus comprises a liquid electrophotography system.

* * * * *

UNITED STATES PATENT AND TRADEMARK OFFICE

CERTIFICATE OF CORRECTION

PATENT NO. : 8,583,021 B2
APPLICATION NO. : 13/096610
DATED : November 12, 2013
INVENTOR(S) : Giries Kadis et al.

It is certified that error appears in the above-identified patent and that said Letters Patent is hereby corrected as shown below:

On the Title Page, Item (73), Assignee, in column 1, line 1, delete "Hewlett_Packard" and insert -- Hewlett-Packard --, therefor.

In the Claims

In column 10, line 29, in Claim 3, delete "rover" and insert -- roller --, therefor.

In column 11, line 18, in Claim 7, delete "rover" and insert -- roller --, therefor.

Signed and Sealed this
Third Day of June, 2014

Michelle K. Lee

Michelle K. Lee
*Deputy Director of the United States Patent and Trademark Office*